US005879871A

United States Patent [19]

Ikesu et al.

[11] Patent Number: 5,879,871

[45] Date of Patent: Mar. 9, 1999

[54] SILVER HALIDE COLOR PHOTOGRAPHIC LIGHT SENSITIVE MATERIAL

[75] Inventors: Satoru Ikesu; Vladimir F. Rudchenko; Yutaka Kaneko, all of Tokyo, Japan

[73] Assignee: Konica Corporation, Japan

[21] Appl. No.: 840,307

[22] Filed: Apr. 11, 1997

[30] Foreign Application Priority Data

Apr. 19, 1996 [JP] Japan ..... 8-098167

[51] Int. Cl.[6] ..... G03C 7/34

[52] U.S. Cl. ..... 430/552; 430/553; 430/554; 430/555; 430/556; 430/557; 430/558

[58] Field of Search ..... 430/557, 558, 430/559, 552, 553, 554, 555, 556, 543, 544

[56] References Cited

U.S. PATENT DOCUMENTS 4,869,325 9/1989 Sasaki et al. ..... 430/552
4,968,594 11/1990 Shimazaki et al. ..... 430/552

FOREIGN PATENT DOCUMENTS 0717315 6/1996 European Pat. Off. .

OTHER PUBLICATIONS

European Search Report EP 97 30 2606 and Annex.

*Primary Examiner*—Janet Baxter
*Assistant Examiner*—Amanda C. Walke
*Attorney, Agent, or Firm*—Jordan B. Bierman; Bierman, Muserlian and Lucas

[57] ABSTRACT

A silver halide color photographic light sensitive material is disclosed, containing a coupler highly soluble in organic solvents and superior in dispersibility and dispersion stability in a silver halide emulsion, which is represented by the following formula:

The coupler includes a pyrazolotriazole coupler reprepresented by the following formula:

7 Claims, 1 Drawing Sheet

SILVER HALIDE COLOR PHOTOGRAPHIC LIGHT SENSITIVE MATERIAL

FIELD OF THE INVENTION

The present invention relates to a silver halide color photographic light sensitive material containing a coupler having a novel ballast group.

BACKGROUND OF THE INVENTION

In a silver halide color photographic light sensitive material (hereinafter, also denoted as a color photographic material or photographic material), which incorporates a coupler in a silver halide emulsion layer, an oleophilic ballast group is introduced into the coupler molecule, and the coupler is dissolved in an organic high boiling solvent and dispersed in a hydrophilic colloid to be incorporated in the layer.

Basic properties required for the coupler are that it be highly soluble in a high boiling organic solvent, that it can be readily dispersed in a silver halide emulsion and its dispersion stability be excellent and resist precipitation, that a clear dye image superior in spectral absorption characteristics and having a broad color reproduction region can be formed, which is fast to light, heat and humidity, and that it can be made from inexpensive materials through a fairly simple process, with high reproducibility and yield.

The role of the coupler in the above performance is extensive and specific ballast groups are proposed in Japanese Patents 44-3660, 48-25655, 48-25932, 48-25934, 49-16057, 51-40804, JP-A 47-4481, 49-8228, 50-19435, 51-126831, 52-86333, 56-30126, 57-146251, 58-42045, 59-177557, and 60-24547, U.S. Pat. Nos. 2,908,573, 2,920,961 and 3,227,544.

However, these ballast groups were proved to be insufficient for satisfying the above properties.

In particular, a pyrazolotriazole type cyan coupler requires further improvements in terms of high solubility in a high boiling organic solvent, excellent color reproduction in a high density region and capable of being produced from inexpensive materials through a relatively simple synthesis method with high reproducibility and high yield.

SUMMARY OF THE INVENTION

In view of the above, the present invention has been realized. It is a first object of the present invention to provide a silver halide color photographic light sensitive material containing a coupler highly soluble in organic solvents (high boiling organic solvents and low boiling organic solvents) and superior in dispersibility and dispersion stability in a silver halide emulsion.

It is a second object of the invention to provide a color photographic material achieving a color dye image with sufficiently high color density, and superior in spectral absorption characteristics at high density regions.

It is a third object of the invention to provide a color photographic material in which a color dye image formed has superior fastness to light and humidity.

It is a fourth object of the invention to provide a color photographic material containing a coupler which can be synthesized from inexpensive materials through a simple process.

The above objects of the present invention can be solved by the following constitution.

1. A silver halide color photographic light sensitive material comprising a coupler represented by the following formula (I):

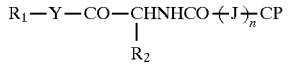

Formula (I)

wherein $R_1$ is an alkyl group; an aryl group, or a heterocyclic group; Y is —O—, or —NH—; $R_2$ a substituent having two or more carbon atoms; J is a bivalent linkage group; n is an integer of 1 or 2; CP is a coupler residue.

2. The silver halide color photographic light sensitive material described in 1, wherein said coupler represented by formula (I) is represented by the following formula (II):

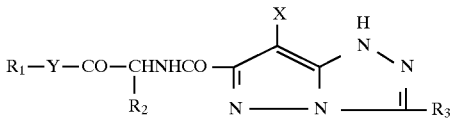

Formula (II)

wherein $R_1$, $R_2$ and Y each have the same definition as $R_1$, $R_2$ and Y in formula (I), respectively; X is a hydrogen atom or a group capable of being split off upon reaction with an oxidation product of a developing agent; and $R_3$ is a substituent.

DETAILED DESCRIPTION OF THE INVENTION

Figure 1:
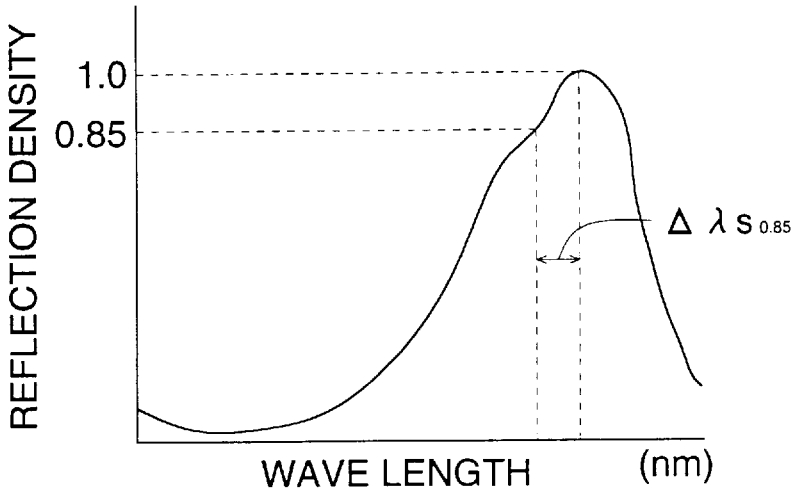
FIG. 1 illustrates reflection spectrum.

In formula (I), $R_1$ is an alkyl group, an aryl group, or a heterocyclic group.

The alkyl group is preferably one having 6 to 32 carbon atoms, which may be straight chained or branched. Exemplary examples thereof include a octyl group, decyl group, dodecyl group, tetradecyl group, octadecyl group, and 2-ethylhexyl group.

The aryl group includes a phenyl group, which has preferably a substituent having 6 to 32 carbon atoms. Examples of the substituent include an alkyl group, an aryl group, an anilino group, an acylamino group, a sulfonamido group, an alkylthio group, an arylthio group, alkenyl group and a cycloalkyl group. In addition thereto, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic-oxy group, siloxy group, an acyloxy group, a sulfonyloxy group, a carbamoyloxy group, an amino group, an alkylamino group, an imido group, an ureido group, a sulfamoylamino group, an alkoxycarbonylamino group, an aryloxycarbonyl group, an aryloxycarbonyl group, a heterocyclic-thio group, a thioureido group, a carboxy group, a hydroxy group, a mercapto group, a nitro group, and a sulfo group are also included. Furthermore, a spiro compound residue and bridged hydrocarbon compound residue are included.

Examples of the heterocyclic group include a 2-pyridyl group, and 3-pyridyl group. The heterocyclic group preferably has a substituent having 6 to 32 carbon atoms. Examples of the substituent include the same one as described in the above phenyl group.

In formula (I), $R_1$ is preferably an alkyl group or aryl group, and more preferably alkyl group.

In formula (I), Y is —O— or —NH— and preferably —O—.

In formula (I), $R_2$ is a substituent having 2 or more carbon atoms. Examples thereof include an i-propyl group, 2-methylpropyl group, 1-methylpropyl group, and phenylmethyl group.

In formula (I), J is a bivalent linkage group and preferably an alkylene group or an arylene group. In formula (I), n is 0 or 1, and preferably 0.

In formula (I), CP is a coupler residue. Representatives of a yellow coupler residue are described in U.S. Pat. Nos. 2,298,443, 2,407,210, 2,875,057, 3,048,194, and 3,447,928; and Farbkuppler eine Literaturubersicht Agfa Mitteilung (Band II) pages 112–126 (1961). Of these, acylacetoanilide type yellow couplers such as a benzoylacetoanilide coupler and pivaloylacetoanilide coupler are preferred.

Representatives of a magenta coupler residue are described in U.S. Pat. Nos. 2,369,489, 2,343,708, 2,311,082, 2,600,788, 2,908,573, 3,062,653, 3,152,896, 3,519,429, 3,725,067, and 4,540,654; JP-A 59-162548, and above-described Farbkuppler eine Literaturubersicht Agfa Mitteilung (Band II) pages 126–156 (1961). Of these, pyrazolone magenta couplers and pyrazoloazole magenta couplers, such as a pyrazoloazole magenta coupler and a pyrazolotriazole magenta coupler are preferred.

Representatives of a cyan coupler residue are described in U.S. Pat Nos. 2,367,531, 2,423,730, 2,772,162, 2,895,826, 3,002,836, 3,034,892, and 3,041,236; JP-A 64-554; and above-described Farbkuppler eine Literaturubersicht Agfa Mitteilung (Band II) pages 156–175 (1961). Of these, phenol cyan couplers, naphthol cyan couplers and pyrazolotriazole cyan couplers are preferred.

Of the coupler residue represented by CP in the formula, pyrazolotriazoles are preferred as the coupler residue, and the coupler represented by formula (I) is more preferably represented by formula (II).

In formula (II), $R_1$, $R_2$ and Y are each the same as $R_1$, $R_2$ and Y in formula (I); and X is a hydrogen atom or a group capable of being split off upon reaction with an oxidation product of a developing agent.

Example of the group capable of being split off upon reaction with an oxidation product of a developing agent include a halogen atom (e.g., chlorine atom, bromine atom and fluorine atom), an alkylene group, an alkoxy group, an aryloxy group, a heterocyclic-oxy group, an acyloxy group, sulfonyloxy group, an alkoxycarbonyloxy group, an aryloxycarbonyl group, an alkyloxalyloxy group, alkoxyoxalyloxy group, an alkylthio group, an arylthio group, a heterocyclic-thio group, an alkyloxythiocarbonylthio group, an acylamino group, a sulfonamido group, a nitrogen-containing heterocyclic group having a bonding site at a nitrogen atom, an alkyloxycarbonylamino group an aryloxycarbonylamino group and a carboxy group. Of these, a hydrogen atom, halogen atom, alkoxy group, aryloxy group, heterocyclic-oxyalkylthio group, arylthio group, heterocyclic-thio group and nitrogen-containing heterocyclic group having a bonding site at a nitrogen atom are preferred.

In formula (II), $R_3$ is a substituent. The substituent by represented by $R_3$ is not limitative, but representatives of the substituent include an alkyl group, an aryl group, an anilino group, an acylamino group, a sulfonamido group, an alkylthio group, an arylthio group, alkenyl group and a cycloalkyl group. In addition thereto, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic-oxy group, siloxy group, an acyloxy group, a sulfonyloxy group, a carbamoyloxy group, an amino group, an alkylamino group, an imido group, an ureido group, a sulfamoylamino group, an alkoxycarbonylamino group, an aryloxycarbonyl group, an aryloxycarbonyl group, a heterocyclic-thio group, a thioureido group, a carboxy group, a hydroxy group, a mercapto group, a nitro group, and a sulfo group are also included. Furthermore, a spiro compound residue and bridged hydrocarbon compound residue are included.

Of the groups represented by $R_3$, the alkyl group is preferably one having 1 to 32 carbon atoms, which may be straight-chained or branched.

The aryl group is preferably a phenyl group.

The acylamino group includes an alkylcarbonylamino group and arylcarbonylamino group.

The sulfonamido group includes an alkylsulfonylamino group and arylsulfonylamino group.

The alkyl component or aryl component in the alkylthio group or arylthio group include the alkyl group or aryl group represented by R described above.

The alkenyl group, which may be straight-chained or branched, is preferably one having 2 to 32 carbon atoms, and the cycloalkyl group is preferably one having 3 to 12 carbon atoms and more preferably 5 to 7 carbon atoms.

The cycloalkenyl group is preferably one having 3 to 12 carbon atoms and more preferably 5 to 7 carbon atoms. The sulfonyl group includes an alkylsulfonyl group and arylsulfonyl group; the sulfinyl group includes an alkylsulfinyl group and arylsulfinyl group; the phosphonyl group includes an alkylphosphonyl group and arylphosphonyl group; the acyl group includes an alkylcarbonyl group and arylcarbonyl group; the carbamoyl group includes an alkylcarbamoyl group and arylcarbamoyl group; the sulfamoyl group includes an alkylsufamoyl group and arylsulfamoyl group; the acyloxy group includes an alkylcarbonyloxy group and arylcarbonyloxy group; the sulfonyloxy group includes an alkylsulfonyloxy group and arysulfonyloxy group; the carbamoyloxy group includes an alkylcarbamoyloxy group and arylcarbamoyloxy group; the ureido group includes an alkylureido and arylureido group; the sulfamoylamino group includes an alkylsulfamoylamino group and arylsufamoylamino group; the heterocyclic group is preferably a 5 to 7-membered ring, including 2-furyl, 2-thienyl, 2-pyrimidinyl, 2-benzothiazolyl, 1-pyrrolyl and 1-tetrazolidine-yl; the heterocyclic-oxy group is preferably 5 to 7-membered ring, including a 3,4,5,6-tetrahydropyranyl-2-oxy group and 1-phenyltetrazole-5-oxy group; the heterocyclic-thio group is preferably a 5 to 7-membered ring, including a 2-pyridylthio group, 2-benzothiazolylthio group, 2,4-diphenoxy-1,3,5-triazole-6-thio group; the siloxy group includes trimethysiloxy group, triethylsiloxy group and dimethylsiloxy group; the imido group includes succinimido group, 3-heptadecylsuccinimido group, phthalimido group and glutarimido group; the spiro compound residue includes spiro-[3,3]-heptane-1-yl; the bridged hydrocarbon compound residue includes bicyclo-[2,2,1]-heptane-1-yl, and tricyclo-[3,3,1,$1^{37}$]-decane-1-yl, 7,7-dimethyl-bicyclo-[2,2,1]-heptane-1-yl.

The substituent represented by $R_3$ is preferably an alkyl group or an aryl group, and more preferably, aryl group.

Representative examples of the compound represented by formula (I) are shown as below, but the present invention is not limited thereto.

(1)
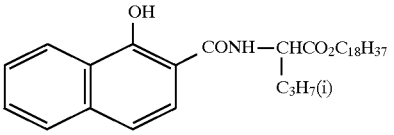
(2)
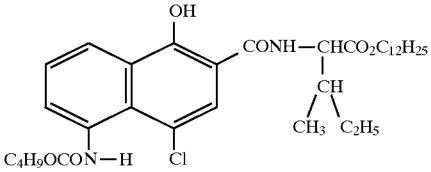
(3)
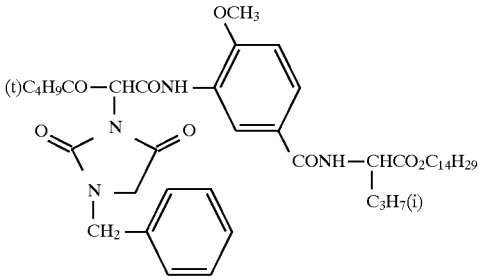
(4)
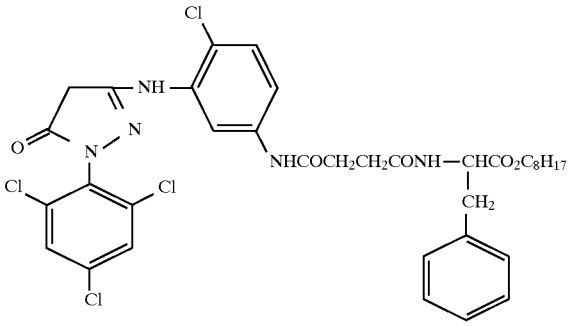
(5)
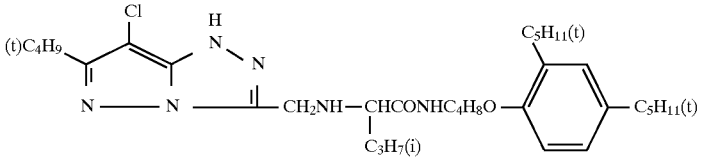
(6)
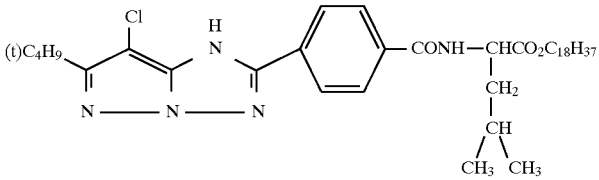
(7)
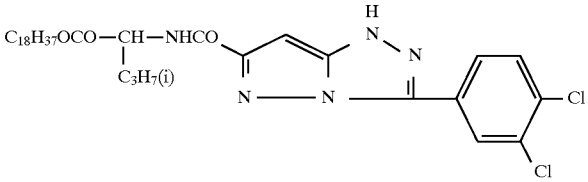
(8)
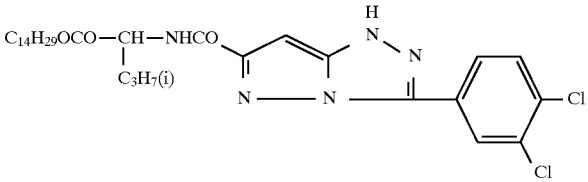

-continued
(9)
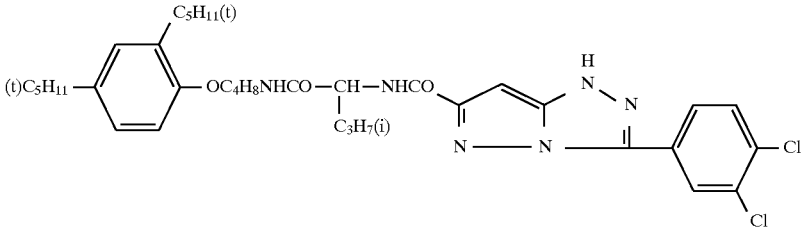
(10)
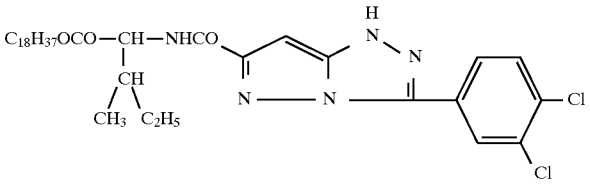
(11)
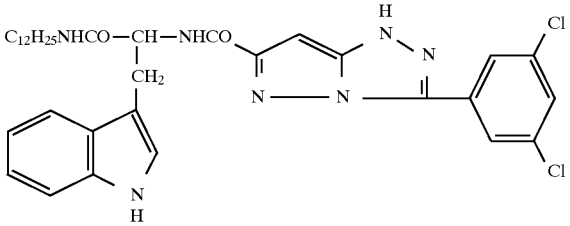
(12)
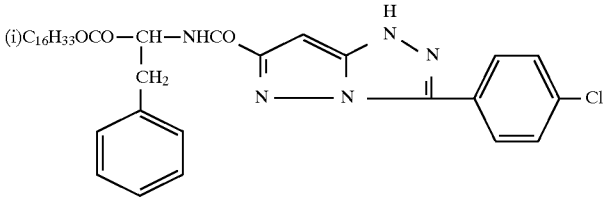
(13)
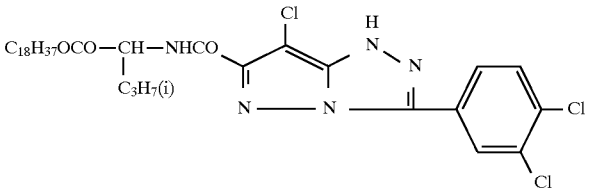
(14)
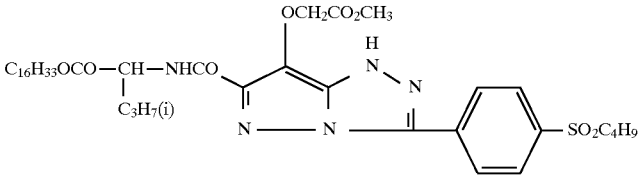
(15)
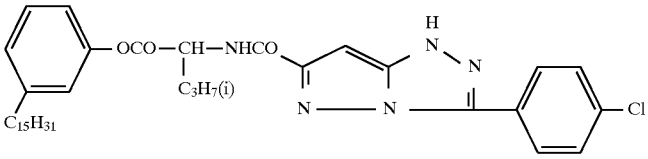
(16)
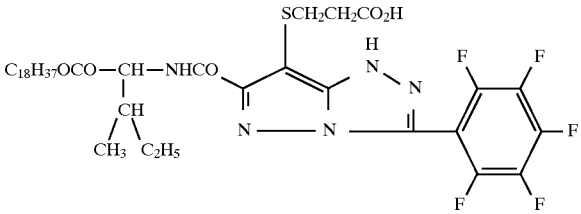

-continued
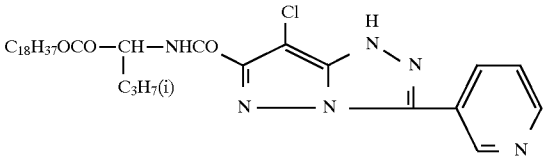
(17)
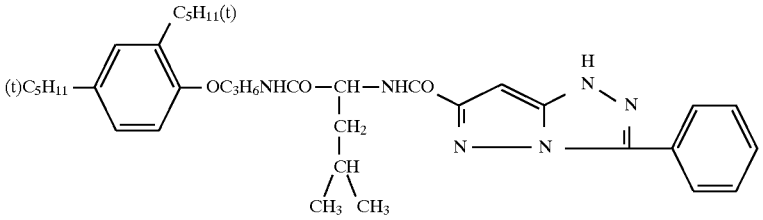
(18)
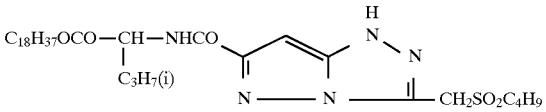
(19)
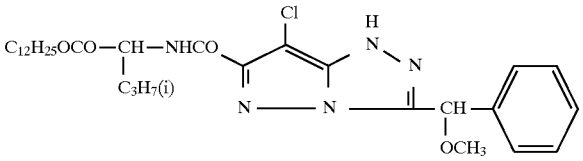
(20)
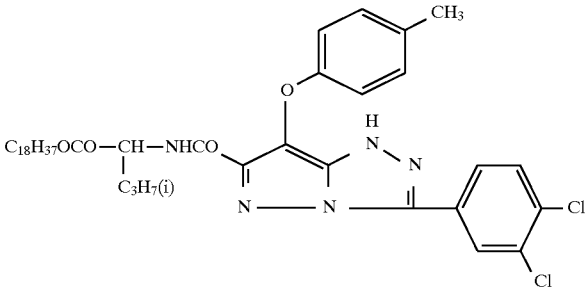
(21)
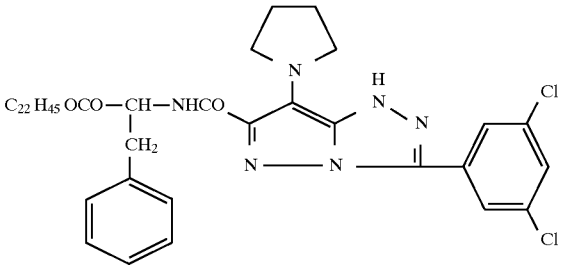
(22)
An example of synthesis of an exemplary compound represented by formula (I) is shown below.
Synthesis example
Exemplified Compound (7) was synthesized according to the following scheme.
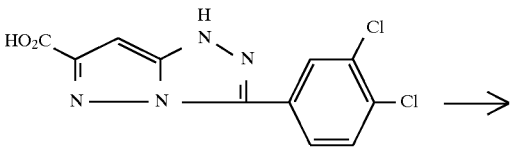
(7a)
-continued
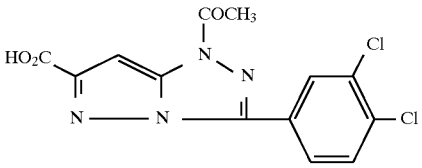
(7b)
i) $SOCl_2$
ii) $C_{18}H_{37}OCO-CH(C_3H_7(i))-NHCO$ (7c)
Exemplified Compound (7)

i) Synthesis of intermediate (7b)

1750 g (5.90 mol) of (7a) was allowed to react in a mixture of 14 liters of acetonitrile, 740 ml of acetic anhydride and 480 ml of pyridine by heating under reflux for 4 hrs. After being allowed to stand until reaching room temperature, a reaction mixture was gradually added into an aqueous solution containing 516 ml of 35% hydrochloric acid. Precipitated crystals were filtered off, washed with 3 liters of water two times and with 4 liters of acetonitrile, and dried to obtain 1975 g of (7b), in a yield of 99%.

ii) Synthesis of intermediate (7c)

1620 g (6 mol) of stearyl alcohol, 703 g (6 mol) of L-valine and 1370 g (7.2 mol) of p-toluenesulfonic acid monohydrate were heated for 8 hrs. under reflux, with removing produced water.

After completion of the reaction, precipitated crystals (p-toluenesulfonic acid salt of intermediate (7c)) were filtered off. The crystals were dispersed in 10 liters of toluene and washed with 5 liters of a 5% sodium hydrogencarbonate aqueous solution, three times. Thereafter, an organic layer was condensed under reduced pressure and intermediate (7c) was obtained in a yield of 85%.

iii) Synthesis of exemplified compound (7)

1700 g (5.01 mol) of (7b) was dispersed in a mixture of 17 liters of toluene and 10 g of N,N-dimethylformamide, and 1790 g (15.0 mol) of thionyl chloride was added thereto. The mixture was allowed to react at 70° C. for 5.5 hrs. After completion of the reaction, solvents were recovered under reduced pressure, 6 liters of toluene was added thereto and then solvents were recovered under reduced pressure.

To the resulting residue was added 17 liters of ethyl acetate and further thereto was dropwise added 3.2 liters of ethyl acetate solution containing 1852 g (5.01 mol) of (7c) at room temperature. Thereafter, 3 liters of an aqueous solution containing 319 g (3.01 mol) of sodium carbonate was dropwise added at room temperature. After completing the addition, the reaction mixture was allowed to react further for 2 hrs. at room temperature. Then, 1310 ml of 29% aqueous ammonium solution was dropwise added and allowed to react at room temperature. After completing the reaction, diluted hydrochloric acid was added to neutralize the mixture, and an organic layer was extracted at 40° C. using a separation funnel. The organic layer was washed with 4 liters of 2% hydrochloric acid aqueous solution one time and 4.5 liters of water five times, and dried under reduced pressure. To the resulting residue was added 9.7 liters of ethanol, and after dissolving with heating, 65 g of activated carbon was added and the solution was filtered out. The filtrate was allowed to stand to be cooled down and recrystalized with stirring. Thereafter, precipitated crystals were filtered off and washed with 5 liters of ethanol to obtain 2919 g of compound (7) in a yield of 90% (m.p.: 103°–104° C.). The structure was confirmed by 1H-NMR, IR and Mass spectrum.

Other couplers of the invention can be synthesized according to the above method.

The coupler of the invention is used within a range of $1\times10^{-3}$ to 1 mol and preferably $1\times10^{-2}$ to $8\times10^{-1}$ mol per mol of silver halide.

The coupler of the invention may be used in combination with another kind of a coupler. The coupler is conventionally incorporated in a silver halide emulsion and the emulsion is coated on a support to prepare a color photographic material.

A coupler of the invention is used in a color photographic light-sensitive material such as a color negative or positive film and a color printing paper.

A photographic material applied with a coupler of the invention, including the above color printing paper, may be of the monochromatic type or the multi-color type. In a multi-color type photographic material, the coupler of the invention may be contained in any layer. A multi-colored light-sensitive material has a dye image-forming component unit having light-sensitivity in each of the three primary color regions. Each of the component units can be comprised of a single or multilayered emulsion layer each light-sensitive to a certain region having a spectrum. The constitutional layers of a light-sensitive material, including an image-forming component unit layer, may be arranged in various orders having been known in the art.

A typical multi-color photographic light-sensitive material comprises a support having thereon a cyan dye image forming component unit comprising at least one red-sensitive silver halide emulsion layer containing at least one cyan coupler (in which at least one cyan coupler is that of the invention), a magenta dye image forming component unit comprising at least one green-sensitive silver halide emulsion layer containing at least one magenta coupler, and a yellow dye image forming component unit comprising at least one blue-sensitive silver halide emulsion layer containing at least one yellow coupler.

The above-mentioned photographic light-sensitive material may have such an additional layer as a filter layer, an intermediate layer, a protective layer or a subcoated layer.

A coupler of the invention may be contained in an emulsion in the manner known so far. For example, the couplers of the invention are dissolved independently or in combination in a high-boiling organic solvent having a boiling point of not lower than 175° C. such as tricresyl phosphate and dibutyl phthalate or a low-boiling solvent such as butyl propionate independently, respectively or, if required, in the mixed solution of the above-mentioned solvents. After that, the resulting solution is mixed with an aqueous gelatin solution containing a surfactant and the mixture is then emulsified by a high-speed rotary mixer or a colloid mill. The resulting emulsion is added to silver halide, so that a silver halide emulsion applicable to the invention can be prepared.

The silver halide preferably applicable to a light-sensitive material applied with a coupler of the invention include, for example, silver chloride, silver chlorobromide and silver chloroiodobromide. Further, a compounded mixture of silver chloride and silver bromide may also be used. To be more concrete, in the case where a silver halide emulsion is used in a color printing paper, a particularly rapid developability is required. Therefore, it is preferable to contain therein a chlorine atom as a halide component of the silver halide and it is particularly preferable that the silver halide is silver chloride, silver chlorobromide or silver chloroiodobromide each containing at least 1% of silver chloride.

A silver halide emulsion is chemically sensitized in an ordinary process, and it may also be optically sensitized to be in any desired wavelength region.

For the purpose of preventing a fog from producing in the courses of manufacturing, preserving or processing a photographic material and/or stabilizing the photographic characteristics of the photographic material, it is allowed to add a compound known in the art as an antifoggant or a stabilizer.

A color photographic material applied with a coupler of the invention may be applied with an anti-color-foggant, a dye-image stabilizer, a UV absorbent, an antistatic agent, a matting agent, a surfactant and so forth which may commonly be used.

The above additives may be referred to the description of Research Disclosure Vol. 176, pp. 22–31, Dec., 1978.

An image can be formed when a color photographic light sensitive material applied with a coupler of the invention is treated in a color-development process having been well-known in the art.

A color photographic light sensitive material applied with a coupler relating to the invention contains a color developing agent in the form of itself or the precursor thereof in the hydrophilic colloidal layer of the light-sensitive material, and the light-sensitive material can be treated in an alkaline activation bath.

A color photographic light sensitive material applied with a coupler of the invention is color-developed and is then subjected to bleaching and fixing treatments. The bleaching and fixing treatments may also be carried out at the same time.

After completing the fixing treatment, a washing treatment is usually carried out. A stabilizing treatment may be carried out in place of the washing treatment, and the two treatments may be carried out in combination.

EXAMPLES

Now, the present invention will concretely be detailed with reference to the following examples. However, the invention shall not be limited thereto.

Example 1

To 1 g of each of inventive and comparative couplers as shown in Table 1 were added tricresyl phosphate in an amount equivalent to the coupler weight and ethyl acetate in an amount of three times the coupler weight, and the temperature at which a coupler is completely dissolved, was measured. Results thereof are shown in Table 1.

Comparative coupler 1 (Comp-1)

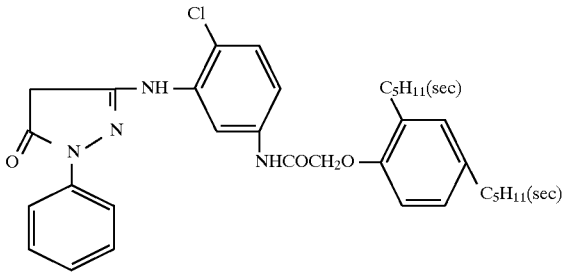

Comparative coupler 2 (Comp-2)

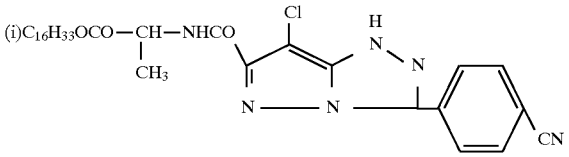

TABLE 1

| Experiment No. | Coupler | Dissolution temp. (°C.) |
|---|---|---|
| 1(Inv.) | Compound (3) | Room temp. |
| 2(Inv.) | Compound (4) | Room temp. |
| 3(Inv.) | Compound (7) | 40 |
| 4(Inv.) | Compound (10) | 30 |
| 5(Comp.) | Comp-1 | 50 |
| 6(Comp.) | Comp-2 | 60 |

As can be seen from Table 1, inventive couplers each were superior in solubility in an organic solvent (high boiling organic solvent and low boiling organic solvent), as compared to comparative couplers.

Example 2

On a paper support laminated with polyethylene on the both side thereof, each of the following layers was coated in order from the support side, so that red-light sensitive color photographic material Sample 1 was prepared. Hereinafter, the amounts of the compounds added will be shown in terms of an amount per sq. meter, unless otherwise expressly stated, (provided that silver halide will be shown in terms of the silver content thereof.)

Layer 1: Emulsion layer

A red-sensitive emulsion layer comprising $9.1\times10^{-4}$ mols of comparative cyan coupler-2 prepared by dissolving in 0.45 g of dioctyl phthalate, 1.3 g of gelatin and 0.2 liters of an red-sensitive silver chlorobromide emulsion (containing 99.5 mol % chloride).

Layer 2: Protective layer

A protective layer containing 0.50 g of gelatin. Thereto, sodium 4-dichloro-6-hydroxy-s-triazine was added in an amount of 0.017 g per g of gelatin.

Next, Samples 2 through 8 of the invention were prepared in the same manner as in Sample 1, except that comparative coupler-2 was replaced respectively by an equimolar coupler, as shown in Table 2.

The resulting Samples 1 through 8 were exposed to light through a wedge in an ordinary method and were then processed according to the following steps.

Processing conditions are as follows

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30° C. to 34° C. | 90 sec. |
| Drying | 60° C. to 80° C. | 60 sec. |

The compositions of the processing solutions used in each of the processing steps were as follows.

Color developer:

| Color developer: | |
|---|---|
| Water | 800 ml |
| Triethanol amine | 10 g |
| N,N-diethyl hydroxylamine | 5 g |
| Potassium bromide | 0.02 g |
| Potassium chloride | 2 g |
| Potassium sulfite | 0.3 g |
| 1-Hydroxyethylidene-1, 1-diphosphonic acid | 1.0 g |
| Ethylenediamine tetraacetic acid | 1.0 g |
| Disodium catechol-3, 5-disulfonate | 1.0 g |
| Diethylene glycol | 10 g |
| 3-Methyl-4-amino-N-(β-methane sulfonamido ethyl) aniline | 4.5 g |
| Fluorescent whitening agent (4,4'-diamino stilbene sulfonic acid derivative) | 1.0 g |
| Potassium carbonate | 27 g |
| Add water to make in total of | 1 liter |
| Adjust pH to be | 10.10 |
| Bleach-fixer: | |
| Ferric ammonium ethylenediamine | 60.0 g |

-continued

| | |
|---|---|
| tetraacetate, dihydrate | |
| Ethylenediamine tetraacetic acid | 3.0 g |
| Ammonium thiosulfate (in an aqueous 70% solution) | 100.0 ml |
| Ammonium sulfite (in an aqueous 40% solution) | 27.5 ml |
| Add water to make in total of | 1 liter |
| Adjust pH with potassium carbonate or glacial acetic acid to be | 5.7 |
| Stabilizer: | |
| 5-Chloro-2-methyl-4-isothiazoline-3-one | 0.2 g |
| 1,2-Benzisothiazoline-3-one | 0.3 g |
| Ethylene glycol | 1.0 g |
| 1-Hydroxyethylidene-1, 1-diphoshonic acid | 2.0 g |
| Sodium o-phenylphenol | 1.0 g |
| Ethylenediamine tetraacetic acid | 1.0 g |
| Ammonium hydroxide (in an aqueous 20% solution) | 3.0 g |
| Fluorescent whitening agent (4,4'-diamino stilbene sulfonic acid derivative) | 1.5 g |
| Add water to make in total of | 1 liter |
| Adjust pH with sulfuric acid or potassium hydroxide to be. | 7.0 |

With the processed Samples 1 through 8, the maximum reflection density ($D_{max}$) of each sample was measured by a densitometer (Model KD-7 manufactured by Konica Corp.). Further, a reflection spectrum that gave a reflection density of 1.0 was measured, from which a difference in wavelength between a density of 1.0 and a density of 1×0.85 (denoted as $\Delta\lambda\ s_{0.85}$) was determined, as illustrated in FIG. 1. Similarly, a reflection spectrum that gave a reflection density of 1.5 was measured, from which a difference in wavelength between a density of 1.5 and a density of 1.5×0.85 (denoted as $\Delta'\lambda\ s_{0.85}$) was determined, and a difference between $\Delta\lambda\ s_{0.85}$ and $\Delta'\lambda\ s_{0.85}$ was determined (denoted as $\Delta\Delta\lambda\ s_{0.85}$). Results thereof are shown below.

Comparative coupler 3 (Comp-3)

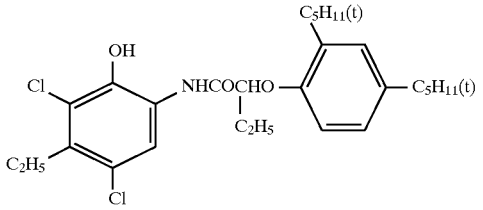

TABLE 2

| Sample No. | Coupler | $D_{max}$ | $\Delta\Delta\lambda$ $S_{0.85}$ (nm) |
|---|---|---|---|
| 1 (Comp.) | Comp-2 | 2.42 | 5 |
| 2 (Comp.) | Comp-3 | 2.35 | 1 |
| 3 (Inv.) | Compound (7) | 2.49 | 1 |
| 4 (Inv.) | Compound (9) | 2.50 | 1 |
| 5 (Inv.) | Compound (15) | 2.51 | 2 |
| 6 (Inv.) | Compound (18) | 2.47 | 1 |
| 7 (Inv.) | Compound (20) | 2.52 | 0 |
| 8 (Inv.) | Compound (22) | 2.44 | 0 |

As can be seen from Table 2, samples containing a coupler of the invention each were small in $\Delta\Delta\lambda\ s_{0.85}$ (that is, small in variation of color tone between higher and lower density regions), as compared to sample containing comparative couplers; and superior in the maximum density (Dmax), as compared to a sample containing comparative coupler-3.

Example 3

On paper support laminated with polyethylene on one side thereof and with polyethylene containing titanium oxide on the other side thereof, each of the layers having the following compositions was coated on the titanium oxide-containing polyethylene layer-side, so that Sample 9 of a multilayered silver halide photographic light-sensitive material prepared. The coating solutions were prepared in the following manner.

Coating solution for Layer 1

Sixty (60) ml of ethyl acetate was added to 26.7 g of yellow coupler (Y-1), 10.0 g of dye-image stabilizer (ST-1), 6.67 g of dye-image stabilizer (ST-2), 0.67 g of additive (HQ-1), anti-irradiation dye (AI-3) and 6.67 g of high-boiling organic solvent (DNP), and the mixture thereof was dissolved. The resulting solution was emulsified and dispersed in 220 ml of an aqueous 10% gelatin solution containing 7.0 ml of 20% surfactant (SU-1) by making use of an ultrasonic homogenizer, so that a yellow coupler dispersed solution could be prepared. The resulting dispersed solution was mixed with a blue light-sensitive silver halide emulsion (containing 8.68 g of silver) that was prepared under the following conditions, so that a coating solution for Layer 1 could be prepared.

Coating solutions for Layers 2 through 7 were each prepared in a manner similar to the above-mentioned coating solution for Layer 1.

As a hardener, (H-1) was added to each of Layers 2 and 4 and (H-2) to Layer 7. As a coating aid, surfactants (SU-2) and (SU-3) were added thereto, so that the surface tension of the layers were controlled. The amounts thereof added to a silver halide photographic light-sensitive material will be hereinafter indicated in terms of grams per sq.meter, unless otherwise noted.

TABLE 3

| Layer | Composition | Amount ($g/m^2$) |
|---|---|---|
| Layer 7 (Protective layer) | Gelatin | 1.00 |
| | DIDP | 0.005 |
| | Antistaining agent (HQ-2) | 0.002 |
| | Antistaining agent (HQ-3) | 0.002 |
| | Antistaining agent (HQ-4) | 0.004 |
| | Antistaining agent (HQ-5) | 0.02 |
| | Compound (F-1) | 0.002 |
| Layer 6 (UV-absorption layer) | Gelatin | 0.40 |
| | UV-absorbent (UV-1) | 0.10 |
| | UV-absorbent (UV-2) | 0.04 |
| | UV-absorbent (UV-3) | 0.16 |
| | Antistaining agent (HQ-5) | 0.04 |
| | DNP | 0.20 |
| | PVP | 0.03 |
| | Anti-irradiation dye (AI-2) | 0.02 |
| | Anti-irradiation dye (AI-4) | 0.01 |
| Layer 5 (Red-sensitive layer) | Gelatin | 1.30 |
| | Red-sensitive silver chlorobromide emulsion (Em-R) | 0.21 |
| | Cyan coupler (Comparative coupler-1) | 0.35 |
| | Dye-image stabilizer (ST-1) | 0.20 |
| | Antistaining agent (HQ-1) | 0.01 |
| | HBS-1 | 0.40 |
| | DOP | 0.40 |
| Layer 4 (UV-absorption layer) | Gelatin | 0.94 |
| | UV-absorbent (UV-1) | 0.28 |
| | UV-absorbent (UV-2) | 0.09 |
| | UV-absorbent (UV-3) | 0.38 |
| | Antistaining agent (HQ-5) | 0.10 |
| | DNP | 0.40 |
| Layer 3 | Gelatin | 1.40 |

TABLE 3-continued

| Layer | Composition | Amount ($g/m^2$) |
|---|---|---|
| (Green-sensitive layer) | Green-sensitive silver chlorobromide emulsion (Em-G) | 0.17 |
| | Magenta coupler (M-1) | 0.23 |
| | Dye-image stabilizer (ST-3) | 0.20 |
| | Dye-image stabilizer (ST-4) | 0.17 |
| | DIDP | 0.13 |
| | DBP | 0.13 |
| | Anti-irradiation dye (AI-1) | 0.01 |
| Layer 2 (Intermediate layer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |

TABLE 3-continued

| Layer | Composition | Amount ($g/m^2$) |
|---|---|---|
| Layer 1 (Blue-sensitive layer) | Gelatin | 1.20 |
| | Blue-sensitive silver chlorobromide emulsion (Em-B) | 0.26 |
| | Yellow coupler (Y-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AI-3) | 0.01 |
| | DNP | 0.20 |
| Support | Polyethylene-laminated paper | |

The coated amounts of silver halide emulsions were indicated as calculated in terms of silver.

Y-1

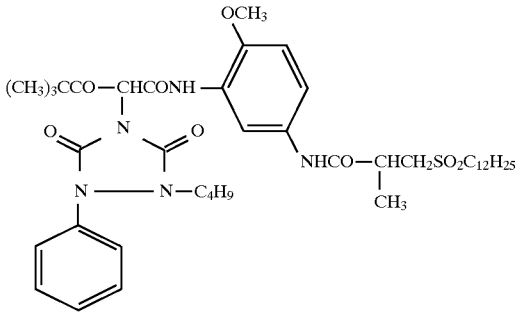

M-1

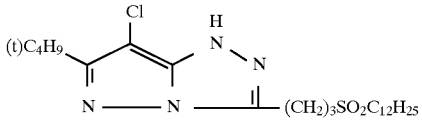

ST-1

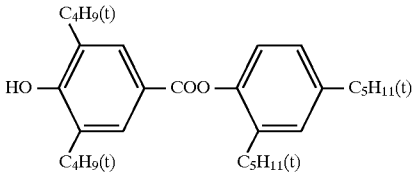

ST-2

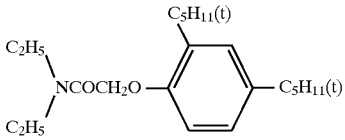

ST-3

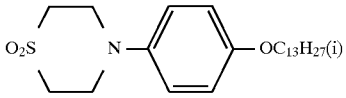

ST-4

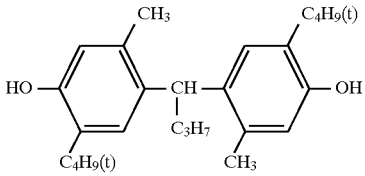

UV-1

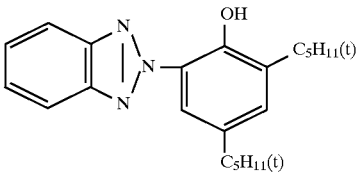

UV-2

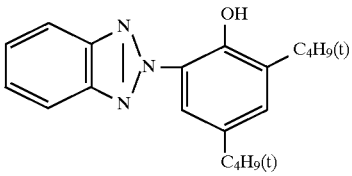

-continued
UV-3
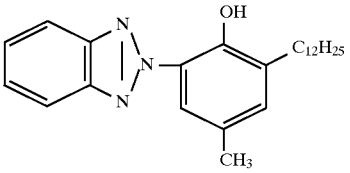
DBP: dibutyl phthalate
DOP: dioctyl phthalate
DIDP: diisodecyl phthalate
DNP: dinonyl phthalate
PVP: polyvinyl pyrrolidone
HQ-1
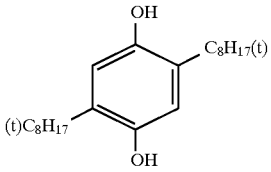
HQ-2
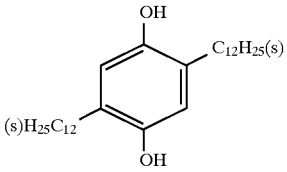
HQ-3
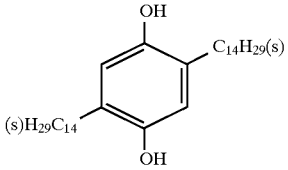
HQ-4
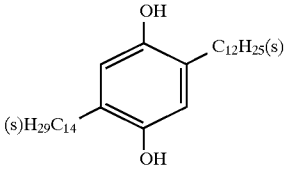
HQ-5
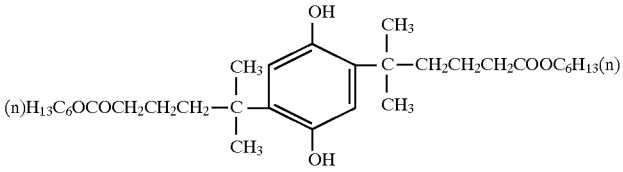
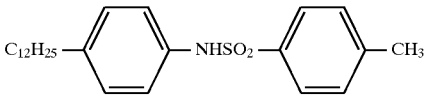
HBS-1
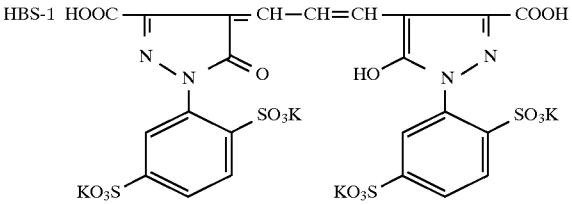
AI-1
AI-2
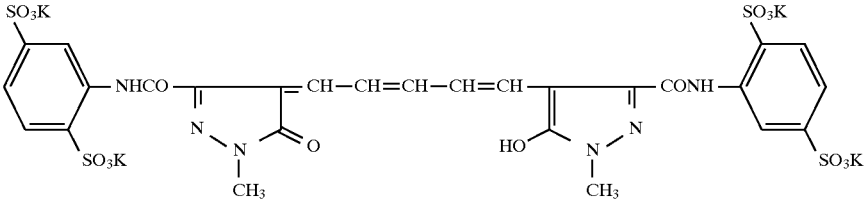
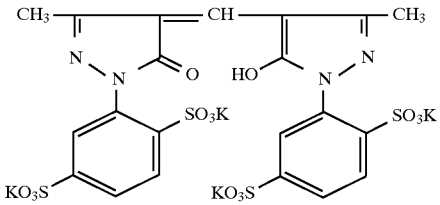
AI-3
AI-4
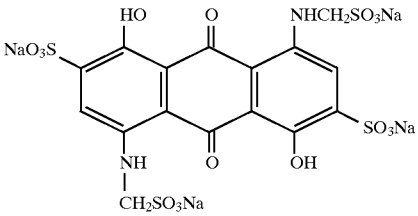
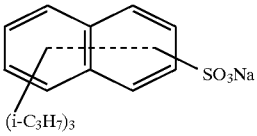
SU-1
SU-2
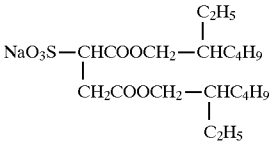

$NaO_3S-CH(CH_2COOCH_2(CF_2CF_2)_2H)COOCH_2(CF_2CF_2)_2H$

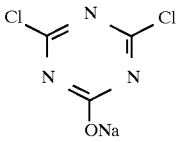

-continued

SU-3 $C(CH_2SO_2CH=CH_2)_4$

H-1

H-2

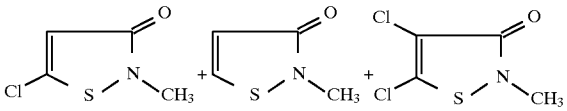

(50%) (46%) (4%)

(Molar ratio)

F-1

Preparation of blue-sensitive silver halide emulsion:

To 1000 ml of an aqueous 2% gelatin solution having been kept at 40° C., the following Solution A and Solution B were each added at the same time by taking 30 minutes with controlling the pHs thereof to be 6.5 and 3.0, respectively. Further, (Solution C) and (Solution D) were each added at the same time by taking 180 minutes with controlling the pH thereof to be 7.3 and 5.5, respectively. The pH controls were carried out by making use of an aqueous solution of sulfuric acid or sodium hydroxide. The pAg controls were carried out by making use of the controller having the following composition. The controller is comprised of an aqueous solution of the mixture of silver halides composed of sodium chloride and potassium bromide. The proportion of the chloride ions to bromide ions was 99.8:0.2 and the concentration of the controller was 0.1 mols per liter when Solutions A and B was mixed up and 1 mol per liter when mixing Solutions C and D.

| | |
|---|---|
| Solution A | |
| Sodium chloride | 3.42 g |
| Potassium bromide | 0.03 g |
| Add water to make | 200 ml |
| Solution B | |
| Silver nitrate | 10 g |
| Add water to make | 200 ml |
| Solution C | |
| Sodium chloride | 102.7 g |
| Potassium bromide | 1.0 g |
| Add water to make | 600 ml |
| Solution D | |
| Silver nitrate | 300 g |
| Add water to make | 600 ml |

After completing the addition, a desalting treatment was carried out with an aqueous 5% solution of Demol N manufactured by Kao-Atlas Co. and an aqueous 20% magnesium sulfate solution and the desalted solution was then mixed with an aqueous gelatin solution, so that monodispersed cubic-shaped emulsion EMP-1 having an average grain-size of 0.85 μm, a variation coefficient (σ/F) of 0.07 and a silver chloride content of 99.5 mol % was obtained.

The resulting emulsion EMP-1 was chemically ripened at 50° C. for 90 minutes by making use of the following compounds, so that a blue-sensitive silver halide emulsion (Em-B) was obtained.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |

-continued

| | |
|---|---|
| Sensitizing dye BS-1 | $4 \times 10^{-4}$ mols/mol of AgX |
| Sensitizing dye BS-2 | $1 \times 10^{-4}$ mols/mol of AgX |

Preparation of green-sensitive silver halide emulsion

Monodisperse type cubic-shaped emulsion EMP-2 having an average grain-size of 0.43 μm, a variation coefficient (σ/F) of 0.08 and a silver chloride content of 99.5% was obtained in the same manner as in the case of EMP-1, except that the time of adding Solution A and Solution B and the time of adding Solution C and Solution D were changed.

The resulting EMP-2 was chemically ripened at 55° C. for 120 minutes by making use of the following compounds, so that green-sensitive silver halide emulsion (Em-G) was obtained.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Preparation of red-sensitive silver halide emulsion

Monodisperse type cubic-shaped emulsion EMP-3 having an average grain-size of 0.50 μm, a variation coefficient (S/R) of 0.08 and a silver chloride content of 99.5% was obtained in the same manner as in the case of EMP-1, except that the time of adding Solution A and Solution B and the time of adding Solution C and Solution D were changed.

The resulting EMP-3 was chemically ripened at 60° C. for 90 minutes by making use of the following compounds, so that red-sensitive silver halide emulsion (Em-R) was obtained.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

The variation coefficient was calculated from the following standard deviation (σ) and an average grain-size ($\bar{\gamma}$)

$$\sigma=[\Sigma(\gamma_i-\bar{\gamma})^2/\Sigma n_i]^{1/2}$$

wherein $\gamma_i$ represents a grain size and $n_i$ represents the number of grains having an grain-size of $\gamma_i$.

BS-1

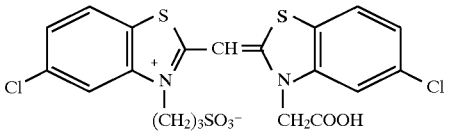

BS-2

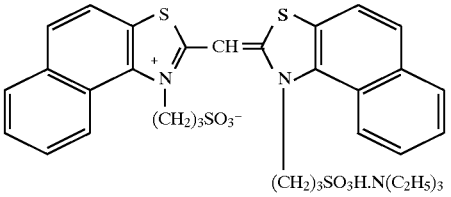

GS-1

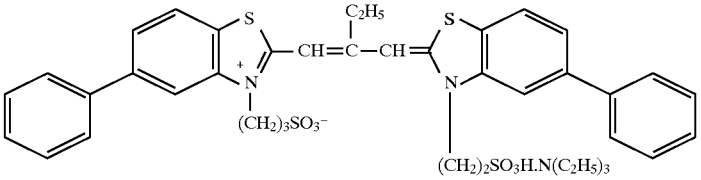

RS-1

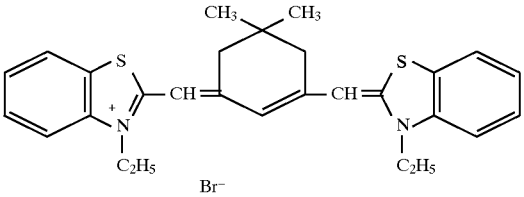

STAB-1

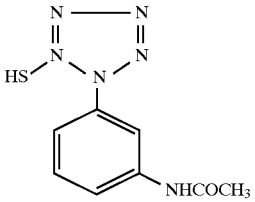

Samples 10 through 16 were each prepared in the same manner as in Sample 9, except that comparative cyan coupler-3 of Layer 5 of Sample 9 was replaced by an equimolar coupler as shown in Table 5.

Samples were exposed and processed in the same manner as in Example 2, and the maximum density (Dmax) of each of the red light-sensitive layers was measured.

Further, the processed samples were allowed to stand under the high temperature and high humidity condition (at 85° C. and 60% R.H.) for 21 days, and the heat resistance and moisture resistance of the resulting dye images were checked up. The heat stability and humidity stability of each dye image were indicated in terms of a dye residual percentage obtained after completing the heat and humidity stability tests.

Results thereof are shown in Table 4

Comparative coupler-4 (Comp-4)

-continued

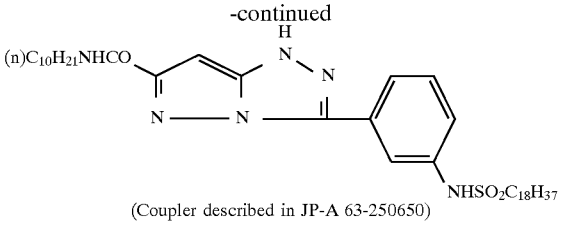

(Coupler described in JP-A 63-250650)

TABLE 4

| Sample No. | Coupler | $D_{max}$ | Dye residual ratio (%) |
|---|---|---|---|
| 9 (Comp.) | Comp-3 | 2.27 | 74 |
| 10 (Comp.) | Comp-4 | 2.12 | 94 |
| 11 (Inv.) | Compound (2) | 2.49 | 72 |
| 12 (Inv.) | Compound (7) | 2.40 | 98 |
| 13 (Inv.) | Compound (8) | 2.39 | 98 |
| 14 (Inv.) | Compound (9) | 2.42 | 99 |
| 15 (Inv.) | Compound (10) | 2.41 | 99 |
| 16 (Inv.) | Compound (21) | 2.42 | 97 |

As can be seen from Table 4, samples containing couplers of the invention each were high in Dmax and the dye residual ratio, that is, superior in color forming and fastness to heat and humidity, as compared to samples containing comparative couplers-3 and 4.

What is claimed is:

1. A silver halide color photographic light sensitive material comprising a support having thereon a silver halide emulsion layer, wherein said silver halide emulsion layer comprises a coupler represented by the following formula (I):

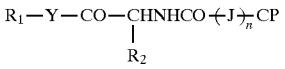

Formula (I)

wherein $R_1$ is an alkyl group, an aryl group or a heterocyclic group; Y is —O— or —NH—; $R_2$ is a substituent having 2 or more carbon atoms; J represents a bivalent linkage group; n is 0 or 1; and CP represents a coupler residue.

2. The photographic material of claim 1, wherein said coupler is contained in an amount of $1\times10^{-3}$ to 1 mol per mol silver halide.

3. The photographic material of claim 1, wherein said silver halide emulsion layer further contains silver halide grains comprising silver chloride, silver chlorobromide or silver iodochlorobromide.

4. The photographic material of claim 1, wherein said coupler is represented by formula (II):

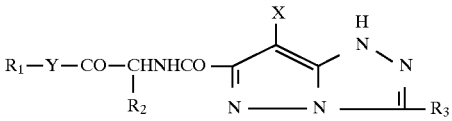

formula (II)

wherein $R_1$, $R_2$ and Y each have the same as defined in $R_1$, $R_2$ and Y of formula (I), respectively; X represents a hydrogen atom or a group capable of being split off upon reaction with an oxidation product of a developing agent; and $R_3$ represents a substituent.

5. The photographic material of claim 4, wherein, in formula (II), $R_3$ is an alkyl group or an aryl group.

6. A silver halide color photographic light sensitive material comprising a support having thereon a cyan dye-forming unit comprised of a red-sensitive silver halide emulsion layer containing a cyan dye-forming coupler, a magenta dye-forming unit comprised of a green-sensitive silver halide emulsion layer containing a magenta dye-forming coupler and a yellow dye-forming unit comprised of a blue-sensitive silver halide emulsion layer containing a yellow dye-forming coupler, wherein said cyan dye-forming coupler is represented by formula (II):

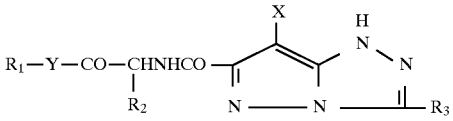

formula (II)

wherein $R_1$ is an alkyl group, an aryl group or a heterocyclic group; Y is —O— or —NH—; $R_2$ is a substituent having 2 or more carbon atoms; X represents a hydrogen atom or a group capable of being split off upon reaction with an oxidation product of a developing agent; and $R_3$ represents a substituent.

7. The photographic material of claim 6, wherein, in formula (II), $R_3$ is an alkyl group or an aryl group.

* * * * *